United States Patent [19]

Sakai et al.

[11] 4,285,227

[45] Aug. 25, 1981

[54] EDGE ROLL ASSEMBLY FOR MANUFACTURING A TAPER LEAF SPRING

[75] Inventors: Yoshihiro Sakai; Jun Takahashi; Toshiaki Satoh; Akira Ohno, all of Yokohama, Japan

[73] Assignee: NHK Spring Co., Ltd., Yokohama, Japan

[21] Appl. No.: 43,838

[22] Filed: May 30, 1979

[51] Int. Cl.[3] ..... B21B 27/00; B21H 8/02

[52] U.S. Cl. ..... 72/240; 72/234

[58] Field of Search ..... 72/240, 199, 366, 234

[56] References Cited

U.S. PATENT DOCUMENTS

| | | | |
|---|---|---|---|
| 1,650,607 | 11/1927 | Cook | 72/235 |
| 3,323,342 | 6/1967 | Baker | 72/200 |
| 3,336,778 | 8/1967 | Follrath | 72/226 X |
| 3,688,548 | 9/1972 | Kawaguchi et al. | 72/234 |
| 3,757,556 | 9/1973 | Kawawa et al. | 72/234 |

FOREIGN PATENT DOCUMENTS

| | | | |
|---|---|---|---|
| 596308 | 2/1978 | U.S.S.R. | 72/240 |

*Primary Examiner*—Milton S. Mehr

*Attorney, Agent, or Firm*—Fleit & Jacobson

[57] ABSTRACT

In an apparatus for manufacturing a taper leaf spring, by which after performing rolling on the edges of a sheet spring material in the direction of its breadth, rolling for tapering the sheet in the direction of its thickness is carried out, an edge roll assembly is employed for the sake of rolling in the breadth direction. In the edge roll assembly, constraining flanges for regulating the sheet thickness are provided on both ends of the main body of the edge roll so that expansion of both sides of a sheet spring material in the sheet thickness direction due to the effect of rolling in the sheet breadth direction is suppressed by the flanges and the thickness of a sheet spring material is kept uniform as a whole prior to performing rolling in the sheet thickness direction.

4 Claims, 13 Drawing Figures

$B_1$ : 51.71 ( Amount of Press-down 18.29 / Rate of Press-down 26.13 % )

$H_1$max 12.15 $H_1$ min 11.0

H 11.74 (= $F_1/B_1$)

EDGE ROLL ASSEMBLY FOR MANUFACTURING A TAPER LEAF SPRING

BACKGROUND OF THE INVENTION

Field of the Invention

This invention relates to an edge roll assembly employed for rolling a sheet spring material in its breadth direction in a taper leaf manufacturing apparatus by which after the edges of a sheet spring material are rolled in its breadth direction, the material is subjected to rolling in its thickness direction.

A taper leaf employed for the construction of a laminated spring is such a leaf that tapers are formed at both ends of a flat sheet.

The conventional method for manufacturing such a taper leaf is to form tapers by performing rolling work in varying press-down amounts by means of two rolling rolls or one rolling roll while transmitting a spring material. At this time, naturally, expansion towards sidewise direction takes place at the worked terminal of a sheet spring material, accompanying rolling work. If breadth enlarges due to sidewise expansion, there appear problems in regard to quality such as stress distribution and weight lightening and problems in regard to manufacturing such as fabrication. Therefore, it is necessary that the portion having expanded breadth should be adjusted by means of cutting, grinding and abrading, press work, etc. before or after taper rolling. That is, work is to be carried out by pre-estimating breadth expansion due to rolling, amending beforehand the amount of breadth by means of a cutter blade, a breadth narrowing press, etc. and then taper rolling or by applying the above amending process after taper rolling. However, there are defects that these operations have little prospects of success and the shapes of both sides of a leaf spring are poor at the time of completion, or especially in case of breadth narrowing press, a warp is caused in sidewise direction at a sheet spring material so that buckling is brought about.

Except the above process, there is a process that by making small the diameter of a rolling roll so as to make little the rolling amount at one time, the amount of breadth expansion is made less and rolling is repeated a number of times. However, in this process, rolling efficiency is bad and breadth expansion cannot be fully suppressed. Furthermore, there is a taper rolling method in which metal molds, grooved rolls, etc. are employed so that sidewise expansion is suppressed at a worked sheet spring material. In this method, the emergences of swells and scars are feared and the quality maintenance is difficult.

SUMMARY OF THE INVENTION

The first object of this invention is to furnish an edge roll assembly in a taper leaf manufacturing apparatus so improved that inequality does not emerge in the thickness of a leaf spring, waste of material is dispensed with, work units are reduced and goods of high quality without swell or scar are obtained.

The other objects and characteristics of this invention will be clarified in the following explanation which will be made with reference to the accompanying drawings.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

Figure 1:
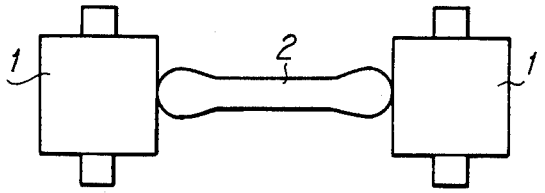
FIG. 1 is a drawing elucidating the case of rolling for breadth narrowing by means of flat rolls.
Figure 2:
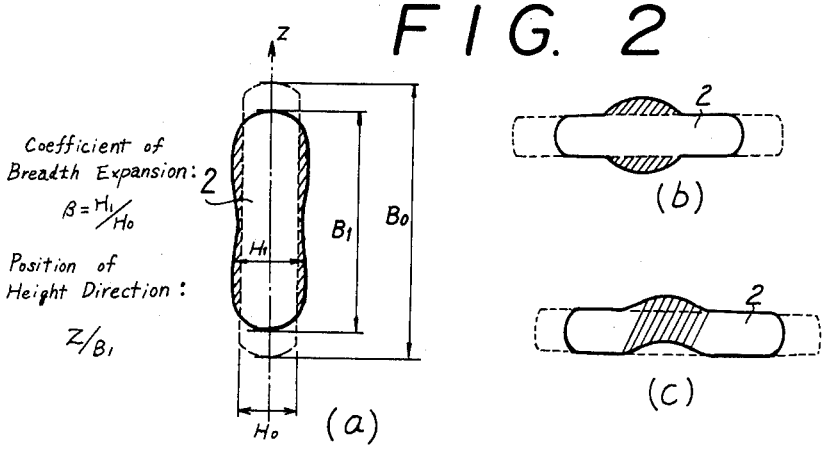
FIG. 2 is a sectional view of a sheet spring material in case of performing breadth narrowing rolling by employing flat steel rolls.
Figure 3:
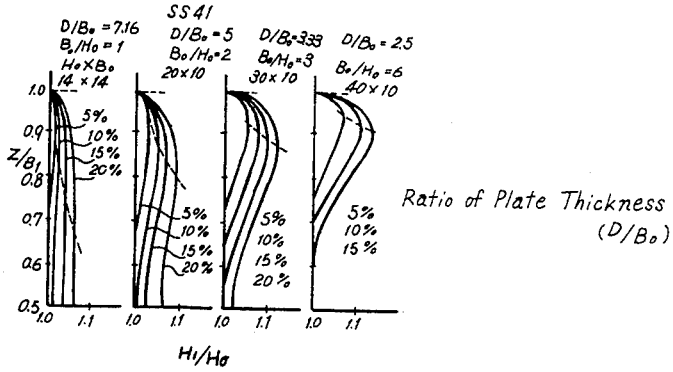
FIG. 3 is a graph concerning influences given by sheet breadth ratios and roll diameters to coefficients of expansion in plate thickness direction.

In FIG. 1, a pair of rolling rolls conventionally generally used for breadth narrowing are diagrammatically illustrated. The rolling rolls indicated in this Figure are flat rolls 1,1. When rolling work is done by placing a sheet spring material 2 between these rolls, expansions take place in sidewise direction near the plane of contact with rolls 1 and on both sides of a sheet spring material (portions of oblique lines in FIG. 2 (*a*)), and its cross sectional shape becomes double barrel-like. The larger the ratios of sheet breadth ($B_o/H_o$) are, these expansions grow the more remarkable. The smaller the diameters of the rolls are, the expansions also grow the more remarkable. If the rate of pressing is increased, expansions take place in sidewise direction in the middle of the cross sectional shape (portions of oblique lines in FIG. 2 (*b*)) so that it becomes single barrel-shaped. The relations of the ratios of plate breadth and the diameters of rolls versus the cross sectional shapes of a sheet spring material are as indicated in FIG. 3. Ordinarily, since the sheet breadth to thickness ratio is so large as 4~8, if rolling for breadth narrowing is performed by means of flat rolls, buckling and sheet thickness alterations bring about an uneven cross sectional shape (double barrel-like), so that a result not varying from a result brought about by other conventional processes is produced.

Figure 4:
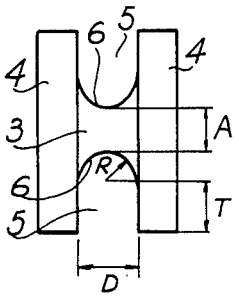
FIG. 4 is a front view of an edge roll having grooves used in this invention.

Hence, in order to avoid a double barrel-like cross sectional shape brought about by rolling for breadth narrowing, the instant inventor has conducted rolling for breadth narrowing by means of rolls having grooves as shown in FIG. 4 and carried on various kinds of experiments concerning the depth of groove, the breadth of groove and the diameter of roll affecting the cross sectional shape. The inventor has thus succeeded in acquiring appropriate specifications of edge rolls.

As to a roll having grooves shown in FIG. 4, regulating flanges 4,4 constraining the expansion of a sheet spring material in the direction of sheet thickness are provided confronting with each other at the outer terminal peripheries of the main roll body 3, constituting substantially the caliber of ring-like grooves. At the bottom 6 of the groove, a root curved to the direction of plate thickness is formed, continuing with the inside planes of the above regulating flanges. It is not necessarily required that this curved root be continued with the inside planes of the regulating flanges 4,4. The depth of the groove is denoted as T, its breadth as D and the diameter of the roll as A.

Figure 5:
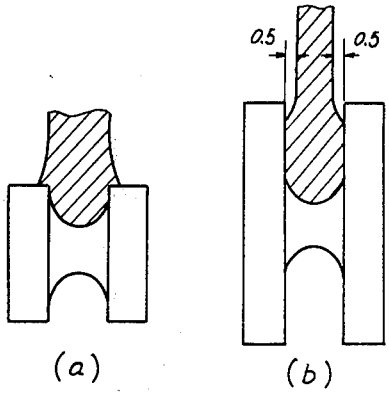
FIG. 5, (*a*) and (*b*), are drawings illustrating respectively cases of little groove depth and large groove depth.

If the depth of the roll groove T is made small, the material flows out of the roll groove 5 as shown in FIG. 5 (*a*) so that step-like differences are produced. These step-like differences remain as scars after later taper rolling, which is not desirable. Then, providing the depths of the groove as T=5, 11 and 26 mm, experiments were conducted for the sheet thicknesses 11, 13 and 16 mm of spring materials, the amounts of breadth narrowing being varied. The results were as shown in the following Table 1.

TABLE 1

| Depth of groove (mm) | Amount of breadth 2 | | | 5 | | | 10 | | | 20 | | |
|---|---|---|---|---|---|---|---|---|---|---|---|---|
| | Sheet thickness (mm) | | | | | | | | | | | |
| | 11 | 13 | 16 | 11 | 13 | 16 | 11 | 13 | 16 | 11 | 13 | 16 |
| 5 | O | O | O | X | X | X | X | X | X | X | X | X |
| 11 | O | O | O | O | O | O | O | O | O | O | O | O |
| 15 | O | O | O | O | O | O | O | O | O | O | O | O |
| 26 | O | O | O | O | O | O | O | O | O | O | O | O |

The mark X denotes the condition of FIG. 5 (a).
The mark O denotes the condition of FIG. 5 (b).

After breadth narrowing, the sheet spring material spreads out in sidewise direction. At the test pieces of the above experiments, the positions of the maximum plate thickness were located about 10~13 mm towards the center from both sides of the sheet spring material. If this value is smaller than the distance from the bottom of the groove till the end of the constraining flange, or R+T, the condition in FIG. (*a*) is not produced, but the condition in FIG. 5 (*b*) is produced. Therefore, if R+T is more than 13 mm, the test pieces employed in the experiments do not incur any problem in regard to the quality of spring.

Figure 6:
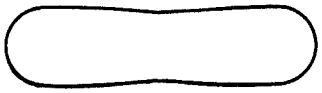
FIG. 6 is a drawing showing a cross section of a metal sheet spring material with narrowed breadth in case of making large the depth of the grooves of edge rolls.

When experiments were carried out with the maximum depth T of groove set at 22 mm and the rates of pressing varied; even in the case of the pressing rate being 26.13%, there was no egress from the groove portion as shown in FIG. 6, nor there emerged a step-like difference. The position of the maximum value thickness (H, max) was located about 11 mm from the sheet edge after breadth narrowing rolling.

Figure 7:
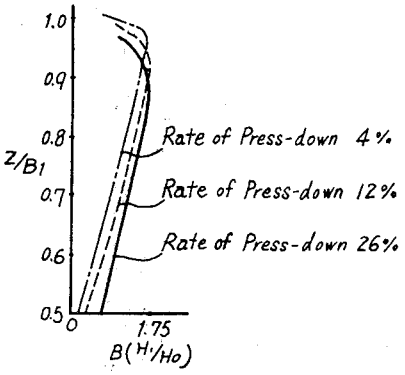
FIG. 7 is a graph indicating distributions of ratios of cross sections, $\beta$, of sheet spring materials with their breadths being narrowed by means of edge rolls having grooves.

By analyzing the above, it has been clarified that in case of the sheet breadth to thickness ratio being 4~8, the position of maximum sheet thickness is not much related with the rate of pressing and is close to the bottom of the groove (Refer to FIG. 7).

Figure 8:
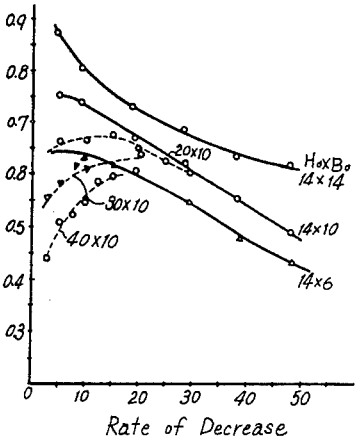
FIG. 8 is a graph showing efficiencies of elongation to rolling direction in case of flat steel roll.

The rate of spread-out to the direction of sheet thickness in case of flat rolls depends on the roll finishing method, its degree and the friction coefficient related from same. However, as indicated in FIG. 8, 70% of the total press-down warp appears as expansion in the direction of sheet thickness. Therefore, 30% is the share of the elongation to the forward-backward direction of rolling.

Figure 9:
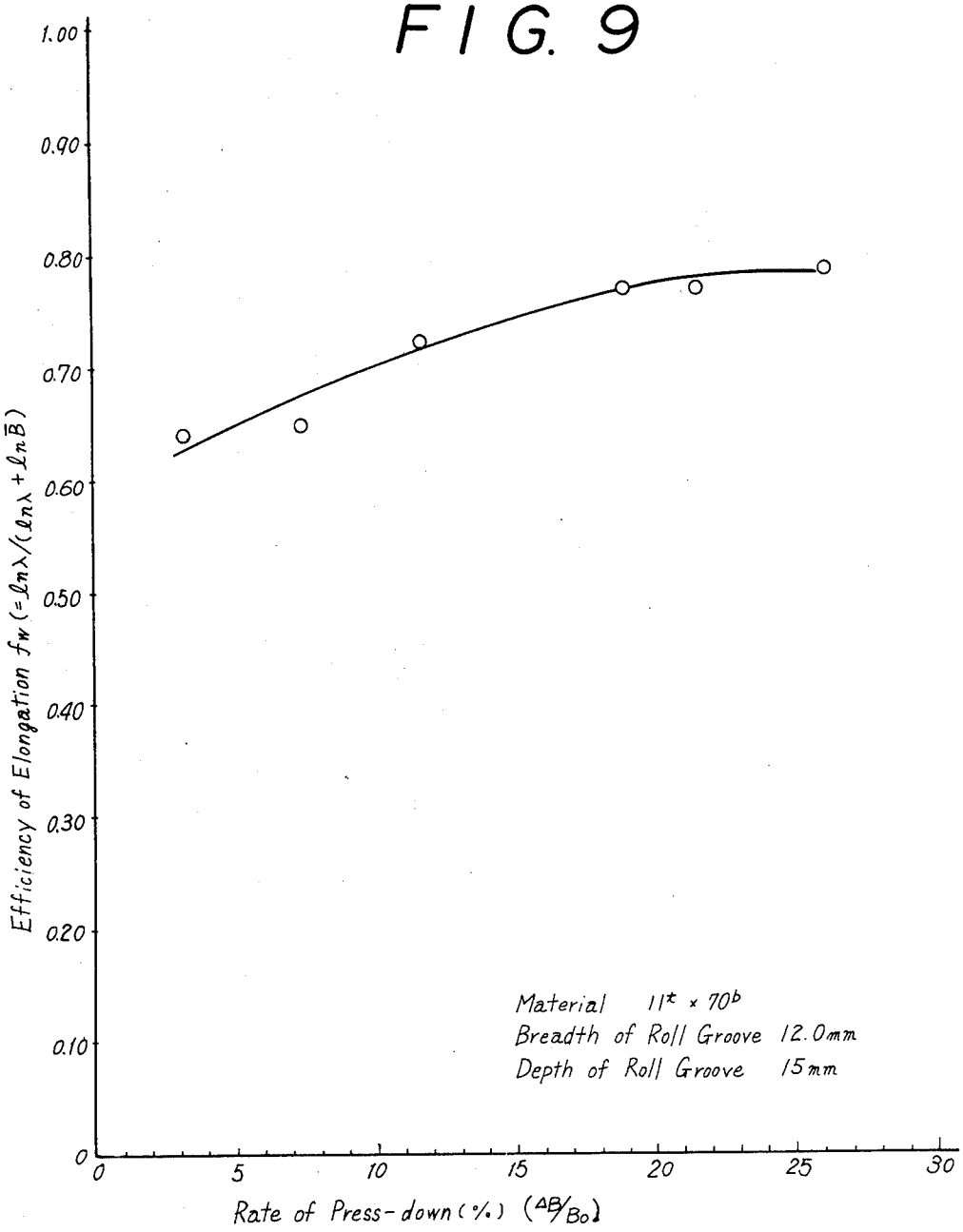
FIG. 9 is a graph showing the relation between rates of pressing and efficiencies of elongation in case of employing edge rolls having grooves.

The efficiency of elongation becomes maximum at a certain rate of pressing. In case of an edge roll having grooves, as is natural, expansion in the direction of sheet thickness is constrained by the groove breadth so that the share of elongation ahead of rolling is increased as shown in FIG. 9, amounting to 70%. The spread-out to the direction of sheet thickness amounts to 30%, being lower by 40% in comparison with the case of flat rolls. It is characteristic that even when the pressing rate is as low as 10%, the rate of elongation grows nearly to 70%.

Figure 10:
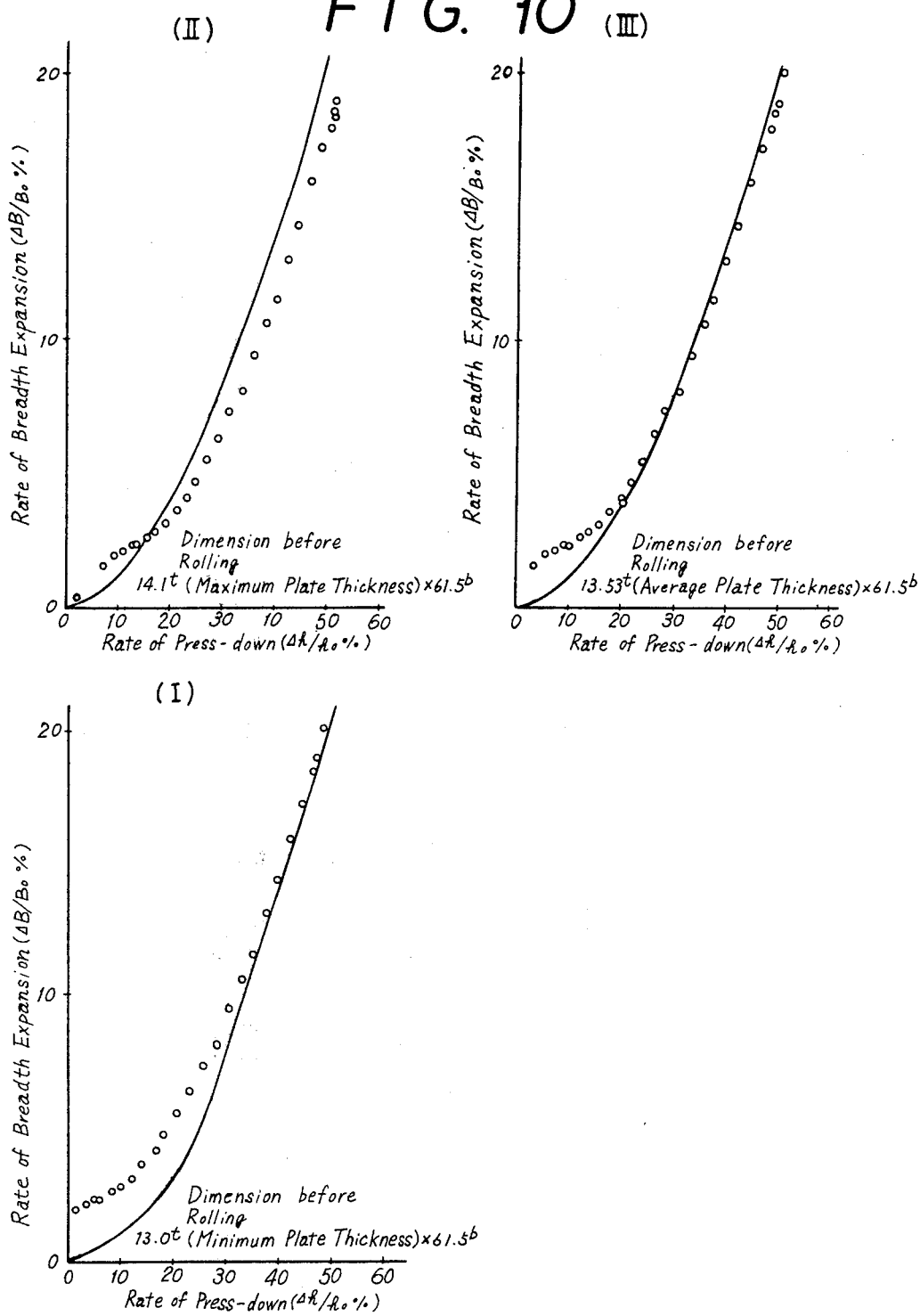
FIG. 10, I, II and III, are graphs comparing theoretical values and actually measured values of breadth expansions when the sheet thickness of a sheet spring material for breadth narrowing rolling is made minimum, maximum or average.

The clearance of groove breadth (difference between the breadth of groove and the thickness of sheet before rolling) has the lower value, the better the rate of elongation is. However, since the amount of spread-out in the direction of sheet thickness does not reduce to zero, seeking from various experimental facts regarding the amount of spread-out in the direction of sheet thickness and the rate of pressing, it has been ascertained that it is best for said clearance to be 0.5~1.0 mm. As to the relation between the breadth expansion and the rate of pressing in case of taper rolling after executing breadth narrowing at a clearance of 1.0 mm, calculated values and actually measured values agree with each other pretty well as shown in FIG. 10 (the real line being calculated values and the marks o being actually measured values).

As for the diameter of roll A in case of a flat roll as shown in FIG. 1, in order to make uniform the expansion in the direction of sheet thickness, a nearly infinitely large diameter of roll is required, which is practically impossible.

Further, such a device is similar to the conventional press metal mold. Necessarily, rolling load turns out to be bigger and sheet thickness to be uneven through breadth direction, which are undesirable in view of quality control. On the other hand, with an edge roll having grooves, expansion in the direction of sheet thickness is constrained by groove breadth, and therefore it is not necessary to enlarge the diameter of roll so that same is sufficient at about $\phi$100~200. Rolling load in case of $\phi$100~200 is 15 tons max. at 14 mm of sheet thickness and 20 mm of pressing amount.

If reviewing the above-explained altogether, when a sheet spring material having such a large breadth to thickness ration as 4~8 is subjected to breadth narrowing through edge rolling by means of flat steel rolls, it becomes double barrel-shaped. If the sheet with such a condition is rolled in the thickness direction, it is difficult to prevent warping and breadth expansion to be brought about after rolling similarly as with the conventional methods.

On the contrary, according to this invention, edge rolls having grooves as shown in FIG. 4 are employed so that it becomes possible to suppress the amount of expansion in the direction of sheet thickness to less than that caused in the case of employing flat steel rolls. Further, it becomes possible to make uniform the amount of expansion in the direction of sheet thickness throughout the whole range of breadth by appropriately selecting the respective dimensions of edge rolls having grooves in consideration of the above-mentioned results of experiments, etc.

As an example of desirable dimensions of an edge roll having grooves shown in FIG. 4, the following can be mentioned.

| | |
|---|---|
| Groove breadth D | t mm + 0.5 ~ 1.0 mm |
| Groove depth | 15 mm |
| Roll diameter A | $\phi$ 100 (t = thickness of rolled sheet spring) |

If, after rolling both sides of a sheet spring material for breadth narrowing by means of edge rolls having grooves with the above dimensions, taper rolling is performed in the direction of sheet thickness, a taper leaf spring can easily be produced in a condition of high precision. It is a matter of course that simultaneously with said rolling for breadth narrowing, taper rolling may be carried out.

What is claimed is:

1. In an apparatus for manufacturing a taper leaf spring from a sheet of spring material, the sheet having top and bottom surfaces and side edges, the apparatus rolling side edges of the sheet to control the breadth of the leaf spring and subsequently rolling at least one of the top and bottom surfaces to control the taper of the leaf spring, the improvement wherein the apparatus includes edge roll assemblies for rolling side edges of the sheet, each of said edge roll assemblies having a concave main roll body for shaping side edges of the sheet to form side edges of the leaf spring and confronting regulating flanges parallel with each other extending outwardly from outer terminal peripheries of the main roll body, the regulating flanges constraining expansion of the sheet in the thickness direction resulting from rolling in the breadth direction thereby regulating thickness of the sheet and increasing elongation of the sheet ahead of a portion thereof being rolled.

2. The improvement of claim 1, wherein the clearance between the regulating flanges is at least 0.5 mm larger than the thickness of the sheet to be rolled.

3. The improvement of claim 1 or 2, wherein the clearance between the regulating flanges is not more than 1.0 mm larger than the thickness of the sheet to be rolled.

4. The improvement of claim 1, wherein the clearance between the regulating flanges is not more than 1.0 mm greater than the thickness of the sheet to be rolled, but at least 0.5 mm greater than that of the sheet to be rolled.

* * * * *